United States Patent [19]

Creutz et al.

[11] 3,993,548

[45] Nov. 23, 1976

[54] ZINC ELECTRODEPOSITION PROCESS AND BATH FOR USE THEREIN

[75] Inventors: Hans Gerhard Creutz, Yale; John B. Capuano, Warren, both of Mich.

[73] Assignee: Oxy Metal Industries Corporation, Warren, Mich.

[22] Filed: May 21, 1975

[21] Appl. No.: 579,529

[52] U.S. Cl. ..... 204/55 R; 204/55 Y

[51] Int. Cl.[2] ..... C25D 3/22; C25D 3/24

[58] Field of Search ..... 204/55 R, 55 Y, 43 Z, 204/44, 114

[56] References Cited

UNITED STATES PATENTS 3,856,637 12/1974 Kessler et al. ..... 204/29

*Primary Examiner*—G. L. Kaplan

*Attorney, Agent, or Firm*—B. F. Claeboe

[57] ABSTRACT

The instant invention is particularly directed to zinc plating baths and a process for employing the same in which quaternary ammonium silicates, preferably of the alkaline type, are utilized. Exemplary of such additives are tetramethylammonium silicate, phenyltrimethyl silicate, disilicate and trisilicate, benzyltrimethyl ammonium silicate and disilicate, and silicates of polymeric quaternary bases. Quaternary ammonium silicates are water soluble, function as chelating agents for metallic impurities in the bath, refine the grain structure of the zinc deposit, and are also effective as auxiliary brighteners.

5 Claims, No Drawings

ZINC ELECTRODEPOSITION PROCESS AND BATH FOR USE THEREIN

BACKGROUND OF THE INVENTION

The present invention is directed to composition and methods for electrodepositing zinc, and more particularly, to the use of certain additives in such baths to reduce the interference of heavy metal impurities with the electroplating function. Also, these additives brighten the electrodeposited zinc, and also serve to refine the grain structure of the zinc deposit. Preferably, the zinc plating bath is of the alkaline type, containing essentially zincate ions and an alkali, however, improved results may also be obtained by the incorporation of the additives in zinc plating solutions which contain cyanide.

It has been proposed in the prior art, as exemplified by U.S. Pat. No. 3,856,637, to add inorganic silicates to a low cyanide zinc plating bath containing less than about 15 grams per liter of free cyanide. Such soluble inorganic silicates generally include sodium silicate, sodium disilicate or sodium metasilicate. The prior art literature attributes the efficacy of the inorganic silicates as additives to some unexplained effect upon the water used either to make up the bath or to rinse the part to be plated. This same prior art indicates that the baths containing inorganic silicates will give essentially the same results as baths which were made up using distilled water, although free of the silicate additives.

BRIEF DESCRIPTION OF THE PRESENT INVENTION

It has been discovered by the present applicants that when there is utilized in zinc plating baths organic ammonium silicates as additives therein, which additives are preferably of the alkaline type, the deficiencies of the prior art are overcome. The additives of this invention preferably are quaternary ammonium silicates which are water soluble, and more particularly, quaternary ammonium silicates which include tetramethylammonium silicate, phenyltrimethylammonium silicate, disilicate and trisilicate, and benzyltrimethylammonium silicate and disilicate. Such silicates meeting the purposes of this invention are expressed by the following general formula:

$$ROR' : xSiO_2 : yH_2O$$

Where R is a quaternary ammonium radical substituted with four organic groups selected from the groups alkyl, alkylene, alkanol, aryl, alkylaryl or mixtures thereof, where R′ is either R or hydrogen, where $x$ equals 1 to 3 and where $y$ equals 0 to 15.

DESCRIPTION OF THE PREFERRED EMBODIMENT

The compositions and methods of this invention broadly comprise zinc plating baths, which may or may not contain cyanide ions, and is further directed to additives for baths of the character mentioned. The compositions of this invention are especially useful in baths which contain no free cyanide, and which are referred to in the art as "alkaline zinc baths". However, the additives of the present invention produce improved results in cyanide-containing baths, although generally the results are less pronounced. It is therefore contemplated that the primary utilization of the additives of the present invention will be in alkaline zinc plating baths, however, this is not the only type of bath in which the additives disclosed herein may be effectively utilized.

The baths of the instant invention include as additives quaternary ammonium silicates. The synthesis and characterization of quaternary ammonium silicates appear in the literature as in the article by Merrill and Spencer, "Some Quaternary Ammonium Silicates", published in the Journal of Physical and Colloid Chemistry, 55, 187 (1951).

These quaternary ammonium silicates are manufactured by the dissolution of silica gel in solutions of quaternary ammonium hydroxides. Generally an excess of silica gel (2 moles of silica gel per mole of base) is revolved in a ball mill for about 48 hours at room temperature. The resultant solutions are concentrated by evaporation under vacuum and recrystallized in hot water before drying to a constant weight in a vacuum desiccator.

By this procedure, and after evaporation and recrystallization, a composition corresponding to that set forth below was obtained:

$$1.00\ ROH : 1.00\ SiO_2 : 4.30\ H_2O$$

Where R is a quaternary ammonium radical substituted with four methyl groups. Upon electrometric titration it was determined that the tetramethylammonium silicate was predominately the salt of the monobasic acid having the formula $(CH_3)_4\ NH\ SiO_3 \cdot 5H_2O$.

All of theses procedures for the preparation of quaternary ammonium silicates of the type herein utilized and their analysis to determine the structural formulae are reported in the literature, such as the above-identified Merrill and Spencer article.

Thus, the quaternary ammonium silicates of the present invention can be expressed either in terms of the compound obtained or in terms of the composition reaction ingredients.

Tetramethylammonium silicate may be defined as either:

$$(CH_3)_4\ NH\ SiO_3 \cdot 5H_2O$$

or $$ROR' : xSiO_2 : yH_2O$$

Where R is the quaternary ammonium radical substituted with four methyl groups, R′ is hydrogen, $x$ equals 1, and $y$ equals 5.

Phenyltrimethylammonium silicate may be defined as either:

$$C_6H_5(CH_3)_3\ NH\ SiO_3 \cdot 5H_2O$$

or $$ROR' : xSiO_2 : yH_2O$$

Where R is the quaternary ammonium radical substituted with one phenyl group and three methyl groups, R′ is hydrogen, $x$ equals 1 and $y$ equals 5.

Phenyltrimethyl ammonium disilicate may be defined as either:

$$[C_6H_5(CH_3)_3\ N]_2\ Si_2O_5 \cdot 3H_2O$$

or $$ROR' : xSiO_2 : yH_2O$$

Where R and R′ are both the quaternary ammonium radical substituted with one phenyl groups and three methyl groups, $x$ equals 3 and $y$ equals 13.

Tetraethanolammonium silicate may be defined as either:

$$(C_2H_4OH)_4\ NH\ SiO_3$$

or $$ROR' : xSiO_2 : yH_2O$$

Where R is the quaternary ammonium radical substituted with four hydroxyethyl groups, R′ is hydrogen, $x$ equals 1 and $y$ equals 0.

Tetramethanol ammonium silicate may be defined as either:

$$(CH_2OH)_4\ NH\ SiO_3$$

or $$ROR' : xSiO_2 : yH_2O$$

Where R is the quaternary ammonium radical substituted with four hydroxylmethyl groups, R′ is hydrogen, $x$ equals 1 and $y$ equals 0.

In addition to the above compositions, benzyltrimethylammonium silicate or benzyltrimethylammonium disilicate may be utilized.

Other ammonium silicates corresponding to the formula $$ROR' : xSiO_2 : yH_2O$$

where R is a quaternary ammonium radical substituted with four organic groups selected from the groups alkylene, alkyl, alkanol, aryl, alkylaryl or mixtures thereof, where R′ is either R or hydrogen, where $x$ equals 1 to 3 and where $y$ equals 0 to 15, may be utilized, so long as the quaternary ammonium silicate is water soluble or is soluble in the bath.

In addition, polymeric ammonium silicates may be prepared by the same general procedure as exemplified below.

More specifically, a solution of 200 ml of N-(hydroxyethyl)-N′,N′-di(hydroxyethyl) polyethylenammonium chloride (0.4 mol-units; chloride concentration 33.4 grams per liter) was concentrated to dryness by flash distillation. The polymer was dissolved in 200 ml of methanol and a solution of 11 grams of potassium hydroxide and 100 ml of methanol was added drop wise to the stirred refluxing solution. The solution was refluxed for 1 hour, cooled, and the precipitated potassium chloride was removed by filtration. There was obtained 350 ml of a methanol solution of the polymeric quaternary ammonium hydroxide.

To the solution of polymeric quaternary ammonium hydroxide (220 ml, 0.25 mole-units) there was added 33 grams of silica gel (70–325 mesh; E. Merck). The mixture was rotated in a ball mill at room temperature for 48 hours, and the excess, finely ground silica gel removed by filtration. There was obtained 250 ml of a solution of the polymeric quaternary ammonium silicate. Generally, the quaternary ammonium silicates are added to the bath in an amount ranging from about 0.01 grams to about 100 grams per liter of bath, and additions of about 1 gram per liter are preferred. Organic silicates function well in plating baths operated under normal production temperatures of about 60° F to 140° F, preferably about 70° F to 100° F.

Of course, the bath may well include other ingredients which serve to modify the bath. For example, inclusions of betaine of nicotinic acid benzylchloride can be utilized as a modifing agent.

Similarly, various polyamine or imines can be added as modifiers. For example, such additives may include polyethylene imines (molecular weight approximately 1800) or reaction products of polyethylene imines with:

$$[Cl - CH_2 - CHOH - CH_2 - N\ (CH_3)_3]^+Cl^-$$

or reaction products of epichlorohydrin and amines, such as hexamethylene tetraamine, imidazole, ammonia, ethylene diamine.

ELECTROPLATING EXAMPLES

EXAMPLE I

An alkaline plating solution of the following composition was prepared:

| | |
|---|---|
| $Zn^-$ | 1.3 oz/gal |
| NaOH | 14.6 oz/gal |
| Benzyl betaine of nicotinic acid | 100 mg/l |
| Polyethlene imine (MW 1000) | 5 g/l |

A standard Hull cell containing 267cc of the above solution was utilized to plate a standard steel panel at ambient room temperature for 15 minutes at 2 amps. The plated panel was dark in the low current density of the panel and stained otherwise.

EXAMPLE II

A solution as set forth in Example I was prepared, however, in this instance 2cc of a quaternary ammonium silicate was obtained by reacting $SiO_2$ powder with tetramethyl ammonium hydroxide.

The same plating procedure as in Example I was followed, and the test panel after 15 minutes of plating at ambient room temperature at 2 amps was free of stains, much brighter, and had a bright low current density recess.

EXAMPLE III

A polymeric quaternary base and the ammonium silicate of the base was prepared in the manner earlier described and tested in a zincate solution. A zincate solution was charged with 3 g/l of the polymeric quaternary ammonium silicate plus 150 mg/l of the sodium bisulfite adduct of anisaldehyde. A steel cathode was plated at 1 amps for 10 minutes at room temperature.

The composition of the zincate solution was:

| | |
|---|---|
| 1.0 oz/gal | Zinc |
| 11.0 oz/gal | NaOH |

Plating was performed in a 267cc standard Hull Cell, and was noted that the zinc plated panel had a bright current density range from about 5 to 30 amps/sq.ft. and the rest of the deposit was semi-bright.

EXAMPLE IV

When a Hull Cell panel was plated under the same conditions as immediately above, but the silicate-free polymeric ammonium base was used instead of the polymeric ammonium silicate. The deposited zinc was not as bright, and the low and high current density areas of the panel were much darker.

It can be seen by the foregoing that applicants have provided zinc plating baths and processes for employing the same in which quaternary ammonium silicates, preferably of the alkaline type are utilized. Exemplary of such additives are tetramethylammonium silicate, phenyltrimethyl silicate, disilicate and trisilicate, benzyltrimethylammonium silicate and disilicate, and silicates of polymeric quaternary bases. Quaternary ammonium silicates are water soluble, function as chelating agents for metallic impurities in the bath, refine the grain structure of the zinc deposit, and are also effective as auxiliary brighteners. It can be further appreciated that an advantage of utilizing polymeric ammonium silicates lies in the fact that only a single additive is necessary in order to obtain sound zinc deposits. The use of inorganic or non-polymeric organic silicates requires at least two additives, namely, an effective amine plus the inorganic or non-polymeric organic silicate.

Various baths and processes of plating have been described herein, and it is believed obvious from the foregoing that other changes and modifications thereto can be effected without departing from the spirit of the invention or the scope of the subjoined claims.

What is claimed is:

1. In a method of electrodepositing zinc from an aqueous alkaline plating bath, the improvement of incorporating into said bath at least one water soluble, chelating and grain refining agent which also serves as a brightener, said agent having the structure:

$$ROR' : xSiO_2 : yH_2O$$

where R is a quaternary ammonium radical substituted with four organic groups selected from the groups consisting of alkyl, alkylene, alkanol, aryl and alkylaryl, where R′ is the same as R or hydrogen, where $x$ equals 1 to 3, and where $y$ equals 0 to 15, and said agent being present in an amount ranging from about 0.01 to about 100 grams per liter.

2. In a method of electrodepositing zinc from an aqueous alkaline plating bath, the improvement of incorporating into said bath a water soluble, organic quaternary ammonium silicate selected from the group consisting of tetramethyl ammonium silicate, phenyltrimethyl ammonium silicate, disilicate, and trisilicate; tetraethanol ammonium silicate; tetramethanol ammonium silicate; benzyltrimethyl ammonium silicate and disilicate; and mixtures thereof.

3. In an aqueous alkaline zinc electroplating bath, the improvement of dissolving in the bath from about 0.01 to about 100 grams per liter of at least one quaternary ammonium silicate having the structure:

$$ROR' : xSiO_2 : yH_2O$$

where R is a quaternary ammonium radical substituted with four organic groups selected from the groups consisting of alkyl, alkanol, alkylene, aryl, and alkylaryl, where R′ is the same as R or hydrogen, where $x$ equals 1 to 3, and where $y$ equals 0 to 15.

4. An aqueous bath composition for the electrodeposition of zinc, comprising zinc ions, an alkali, and from about 0.01 to about 100 grams per liter of at least one quaternary ammonium silicate having the structure:

$$ROR' : xSiO_2 : yH_2O$$

where R is a quaternary ammonium radical substituted with four organic groups selected from the groups consisting of alkyl, alkylene, alkanol, aryl, and alkylaryl, where R′ is the same as R or hydrogen, where $x$ equals 1 to 3, and where $y$ equals 0 to 15.

5. An aqueous bath composition for the electrodeposition of zinc, comprising zinc ions, an alkali, and from about 0.01 to about 100 grams per liter of a water soluble quaternary ammonium silicate selected from the group consisting of tetramethylammonium silicate; phenyltrimethyl ammonium silicate, disilicate, and trisilicate; tetraethanol ammonium silicate; tetramethanol ammonium silicate; benzyltrimethyl ammonium silicate and disilicate; and mixtures thereof.

* * * * *